US007914866B2

(12) United States Patent
Shannon et al.

(10) Patent No.: US 7,914,866 B2
(45) Date of Patent: Mar. 29, 2011

(54) SLEEVED TISSUE PRODUCT

(75) Inventors: Thomas Gerard Shannon, Neenah, WI (US); James Joseph Clark, Jr., Appleton, WI (US); Susan Jean Moder, Appleton, WI (US); Garry Roland Woltman, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1242 days.

(21) Appl. No.: 11/138,098

(22) Filed: May 26, 2005

(65) Prior Publication Data

US 2006/0269706 A1 Nov. 30, 2006

(51) Int. Cl.
*B32B 1/08* (2006.01)
*B32B 23/00* (2006.01)

(52) U.S. Cl. ..... 428/35.2; 428/34.1; 428/35.7; 428/35.9; 428/36.9

(58) Field of Classification Search ..... 428/34.1, 428/34.2, 35.2, 35.7, 35.9, 36.9
See application file for complete search history.

(56) References Cited

U.S. PATENT DOCUMENTS

| | | | | |
|---|---|---|---|---|
| 3,176,338 | A | 4/1965 | Homburger | 407/7 |
| 4,003,973 | A * | 1/1977 | Kurokawa et al. | 264/101 |
| 4,773,532 | A * | 9/1988 | Stephenson | 206/278 |
| 4,902,283 | A | 2/1990 | Rojko et al. | 604/280 |
| 4,964,188 | A | 10/1990 | Olson | 15/227 |
| 5,542,121 | A * | 8/1996 | Lahaussois et al. | 2/59 |
| 5,644,793 | A | 7/1997 | Lahaussois et al. | 2/59 |
| 5,864,883 | A | 2/1999 | Reo | 2/158 |
| 5,987,645 | A | 11/1999 | Teaster | 2/159 |
| 6,027,611 | A | 2/2000 | McFarland et al. | 162/127 |
| 6,141,799 | A * | 11/2000 | Morris | 2/52 |
| 6,258,196 | B1 | 7/2001 | Suzuki et al. | 156/176 |
| 6,332,952 | B1 | 12/2001 | Hsu et al. | 162/127 |
| 6,511,111 | B2 | 1/2003 | Dooley | 294/1.3 |
| 6,573,203 | B1 | 6/2003 | McConnell et al. | 442/79 |
| 6,637,035 | B1 * | 10/2003 | Brinkmann et al. | 2/161.6 |
| 6,808,790 | B2 | 10/2004 | Chen et al. | 428/151 |
| 6,811,338 | B1 | 11/2004 | Manske, Jr. et al. | 401/7 |

(Continued)

FOREIGN PATENT DOCUMENTS

WO WO 98/42290 A1 10/1998

OTHER PUBLICATIONS

American Society for Testing Materials (ASTM) Designation: D 589-97, "Standard Test Method for Opacity of Paper (15° Diffuse Illuminant *A*, 89% Reflectance Backing and Paper Backing)," pp. 1-5, published Nov. 1998.

(Continued)

*Primary Examiner* — Marc A Patterson
(74) *Attorney, Agent, or Firm* — Michael J. Sullivan; Gregory E. Croft

(57) ABSTRACT

A product including two or more plies with each ply including one absorbent layer and a second opposing fluid impervious layer. The two plies are arranged such that the fluid impervious layers face each other and are positioned at the inside of the two-ply product. The two plies are bonded on two or three sides to form a sleeve or a pocket, such that a hand can be inserted between the two plies and positioned in contact with one or both fluid impervious layers. In this manner, the product is absorbent on both sides, and can be utilized on both sides while preventing hand contact with the material absorbed or picked up by the product.

9 Claims, 3 Drawing Sheets

U.S. PATENT DOCUMENTS

| | | | | |
|---|---|---|---|---|
| 2002/0124335 | A1 | 9/2002 | Franko | 15/104.002 |
| 2003/0093046 | A1 | 5/2003 | Kim et al. | 604/367 |
| 2003/0217425 | A1 | 11/2003 | Datta et al. | 15/227 |
| 2006/0093788 | A1 | 5/2006 | Behm et al. | 428/137 |

OTHER PUBLICATIONS

American Society for Testing Materials (ASTM) Designation: D1003-00, "Standard Test Method for Haze and Luminous Transmittance of Transparent Plastics," pp. 1-6, published Jul. 2000.

American Society for Testing Materials (ASTM) Designation: D5725-99, "Standard Test Method for Surface Wettability and Absorbency of Sheeted Materials Using an Automated Contact Angle Tester," pp. 794-800, published May 1999.

TAPPI Official Test Method T 402 om-93, "Standard Conditioning and Testing Atmospheres for Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

TAPPI Official Test Method T 425 om-01, "Opacity of Paper (15/d Geometry, Illuminant A/2°, 89% Reflectance Backing and Paper Backing)," published by the TAPPI Press, Atlanta, Georgia, revised 2001, pp. 1-6.

TAPPI Provisional Method T 530 pm-89, "Size Test for Paper by Ink Resistance (Hercules Method)," published by the TAPPI Press, Atlanta, Georgia, revised 1989, pp. 1-5.

* cited by examiner

SLEEVED TISSUE PRODUCT

BACKGROUND

An important consumer need in towel and tissue products is to prevent the hands and skin from coming into contact with the liquids, foods, and other materials absorbed or picked up by the tissue or towel product during use. For a wide variety of common uses, especially in bathroom hygiene applications, there is an acute desire not to have any contact with the material dislodged or cleaned by the tissue or towel product. On such occasions, rubber or liquid impervious gloves are frequently used to prevent soiling a person's hands while using the tissue or towel product.

In other applications, such as picking up pet residue, there is also a strong desire not to have any contact with the material being picked up. Also, for towel or tissue products used to wrap sanitary napkins or incontinent pads, there is a strong desire not to have any contact with the liquids absorbed by the pad during use.

One means of satisfying this need is to make one side of the sheet moisture impervious (hydrophobic) while making the opposite-side suitable for absorbing and picking up materials (hydrophilic). However, by making one side of a towel or tissue product moisture impervious, a person using the product has to determine which side is the absorbent side and which side is the liquid impervious side, in order to correctly use the product. Another means of satisfying this need, without having a two-sided product, is to use a barrier layer or moisture impervious layer in the center of the tissue or towel product. However, by making the center ply moisture impervious, there is still the problem that if the product is reversed or flipped over to use the other side, a person's hands will come in contact with the soiled side of the tissue or towel product. This defeats the purpose of the barrier layer. Alternatively, if the towel or tissue product is discarded without using the opposite side, then a significant portion of the product's absorbent capacity is not utilized. This is uneconomical for the consumer since they have paid for the absorbent material on both sides but end up using only one side.

Therefore, there is a need to produce tissue or towel products providing protection from the materials being absorbed or picked up by the tissue and towel product that overcome the two-sidedness issue. There is also a need to produce a tissue or towel product that can be used on both sides without the user's hand coming into contact with the soiled dirty surface of the product.

SUMMARY

The inventors have determined that the above needs can be met by a product including two or more plies, with each ply including one absorbent layer and a second opposing fluid impervious layer. The two plies are arranged such that the fluid impervious layers face each other and are positioned at the inside of the two-ply product. The two plies are bonded on two or three sides to form a sleeve or a pocket, such that a hand can be inserted between the two plies and positioned in contact with one or both fluid impervious layers. In this manner, the product is absorbent on both sides, and can be utilized on both sides while preventing hand contact with the material absorbed or picked up by the product.

In a preferred embodiment, the product is provided in a rolled and perforated format such that it takes on the shape and dimensions of a roll of commercially available paper towels. In this manner, the products of the present invention are provided in a convenient format suitable for use by a wide variety of dispensers while providing enhanced hand protection over ordinary paper towels.

Hence, in one aspect, the invention resides in a product including: a plurality of sheets separated by lines of weakness; each of the sheets comprising at least a first ply and a second ply in a facing relationship; the first and second plies each comprising a hydrophilic layer and a hydrophobic layer, the hydrophobic layer of the first ply facing the hydrophobic layer of the second ply; and the first ply joined to the second ply along at least two edges of the sheet, such that when an individual sheet is separated from the plurality of sheets, a sleeve is formed.

In another aspect, the invention resides in a product including: a plurality of sheets separated by lines of weakness; each of the sheets comprising at least a first ply and a second ply in a facing relationship, the plies formed by folding the plurality of sheets such that the first ply overlies the second ply; the first and second plies each comprising a hydrophilic layer and a hydrophobic layer, the hydrophobic layer of the first ply facing the hydrophobic layer of the second ply; and the first ply joined to the second ply along at least one edge of the sheet such that, when an individual sheet is separated from the plurality of sheets, a sleeve is formed.

In another aspect, the invention resides in a product including: a plurality of sheets separated by lines of weakness; each of the sheets comprising at least a first ply and a second ply in a facing relationship; the first and second plies each comprising a hydrophilic layer and a hydrophobic layer, the hydrophobic layer of the first ply facing the hydrophobic layer of the second ply; and the first ply joined to the second ply along at least three edges of the sheet such that, when an individual sheet is separated from the plurality of sheets, a pocket is formed.

In another aspect, the invention resides in a product including: a plurality of sheets separated by lines of weakness; each of the sheets comprising at least a first ply and a second ply in a facing relationship, the plies formed by folding the plurality of sheets such that the first ply overlies the second ply; the first and second plies each comprising a hydrophilic layer and a hydrophobic layer, the hydrophobic layer of the first ply facing the hydrophobic layer of the second ply; and the first ply joined to the second ply along at least two edges of the sheet and folded along a third edge such that, when an individual sheet is separated from the plurality of sheets, a pocket is formed.

BRIEF DESCRIPTION OF THE DRAWINGS

The above aspects and other features, aspects, and advantages of the present invention will become better understood with regard to the following description, appended claims, and accompanying drawings in which:

Figure 1:
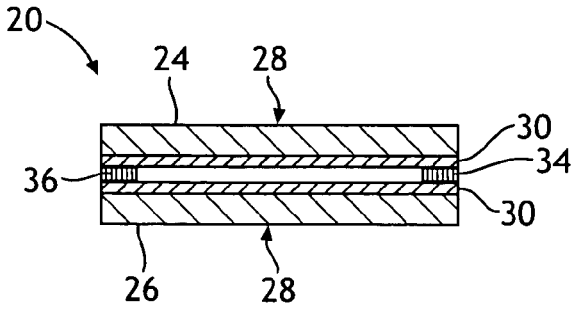
FIG. 1 illustrates a cross-section view of the tissue product taken at 1-1 of FIG. 2

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps, or limitations may be present in addition to the recited elements, functions, steps, or limitations.

As used herein, "hydrophobic layer" means that the layer repels water. A layer can be one or more layers of a multi-layer, single-ply product, an entire ply or multiple plies of a multi-ply product, or one or more layers of any ply within a multi-ply product. The hydrophobicity of the layer can be determined by the contact angle of a drop of water placed on the hydrophobic layer. One suitable test for measuring the contact angle is ASTM D5725-99 Standard Test Method for Surface Wettability and Absorbency of Sheeted Materials Using an Automated Contact Angle Tester. The hydrophobic layers of the present invention will exhibit contact angles of about 80 degrees or greater, more specifically about 85 degrees or greater, and still more specifically about 88 degrees or greater. The specific degree of hydrophobicity of the layer can vary as long as the layer has a low tendency for strikethrough or fluid migration from one side of the product to the other side.

The resistance of the sleeved or mitt tissue products of the present invention to resist fluid strikethrough can be measured by the Hercules Size Test, hereinafter described. The tissue products of the present invention display Hercules Size Test values of about 1 minute or greater, such as from between about 1 minute to about 1200 minutes, or between about 1 minute to about 100 minutes, or between about 1 minute to about 10 minutes.

As used herein, "hydrophilic layer" is any layer that absorbs at least about 4 g/g of water. A layer can be one or more layers of a multi-layer, single-ply product, an entire ply or multiple plies of a multi-ply product, or one or more layers of any ply within a multi-ply product. The absorbent material comprising the layer may be selected from a variety of natural and man made materials and combinations thereof. At least a portion of the hydrophilic layer comprises a fibrous material such as natural or synthetic fibers. The hydrophilic layer may also optionally comprise other materials, such as super absorbent materials and the like. In a specific embodiment, the hydrophilic layer comprises a cellulosic tissue sheet.

As used herein, "joined" encompasses configurations whereby a material or component is secured directly or indirectly (by one or more intermediate members) to another material or component. An example of indirect joining is adhesively securing one member to another member, or adhesively securing one member to one or more intermediate members that is secured to the last member. An example of direct joining includes heat and/or pressure bonding such as crimping or ultrasonic bonding. Joining may include any means known in the art including, for example, adhesives, heat bonds, pressure bonds, ultrasonic bonds, stitching, fasteners, and the like. The joining may be substantially continuous so as to form a substantially continuous seam without a break, or the joining may be discrete such as one or more joined areas separated by one or more unjoined areas, forming an intermittently joined seam.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 2:
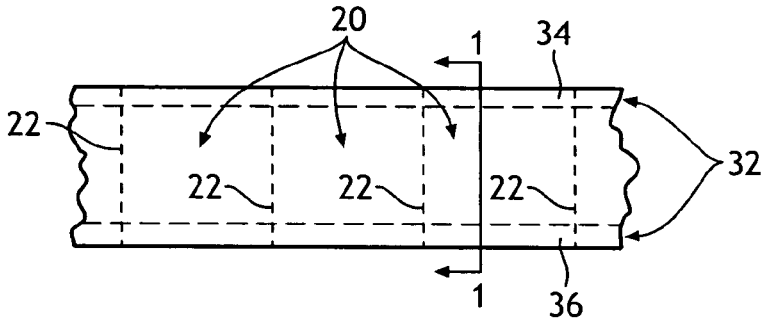
FIG. 2 illustrates a plan view of the tissue product
Figure 3:
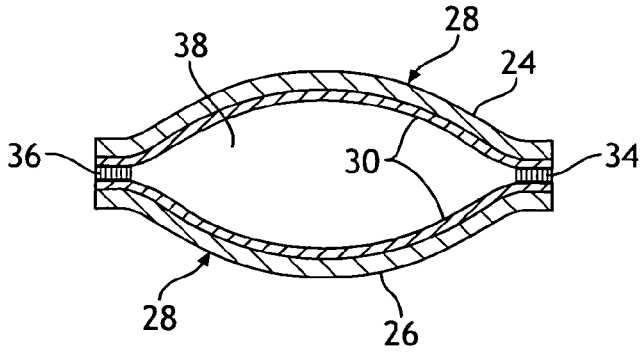
FIG. 3 illustrates a cross-section view taken at 1-1 of FIG. 2 of the tissue product in use

Referring to FIGS. 1, 2, and 3, one embodiment of the invention is illustrated. The product includes a plurality of sheets 20 separated by lines of weakness 22. Each sheet includes a first ply 24 and a second ply 26 in a facing relationship. The first and the second plies (24, 26) each include a hydrophilic layer 28 and a hydrophobic layer 30. The hydrophobic layer 30 of the first ply 24 is arranged facing the hydrophobic layer 30 of the second ply 26. The first and second plies (24, 26) are joined to each other at joining regions 32. In the illustrated embodiment, the joining regions 32 include a top joined edge 34 of each sheet 20 in the machine direction (MD) and a bottom joined edge 36 of each sheet 20 in the machine direction. The lines of weakness 22 are arranged perpendicular to the joined edges (34, 36) in the cross machine direction (CD) of each sheet 20.

Upon removal of an individual sheet 20 by separating adjacent sheets at the line of weakness 22, a sleeve 38 is formed (FIG. 3). In this manner, the sheet 20 can be separated and opened into the sleeve 38 while the joining regions (34, 36) hold the two plies together. To use the product, a hand is inserted into the sleeve 38. In this manner, the product can be used for wiping up spills with either or both of the hydrophilic layers 28 of the first or second ply (24, 26) while the hand remains protected and dry by the hydrophobic layers 30 of the first and second plies (24, 26). Either side of the sheet 20 may be used without compromising the hand protection of the user.

Note that in FIG. 1, the height of the top and bottom joined edges (34, 36) are drawn disproportionately to scale for illustrative purposes. The joined edges 34, 36 may have little to no z-direction height—i.e. much less than the thickness of an individual ply since the two plies can be indirectly joined to each other by an adhesive. However, in other embodiments of the invention, especially where intermediate members are used to join the plies (24, 26), the joined edges (34, 36) can have a significant z-direction height and that height may be greater than, less than, or equal to the thickness of an individual ply.

Figure 4:
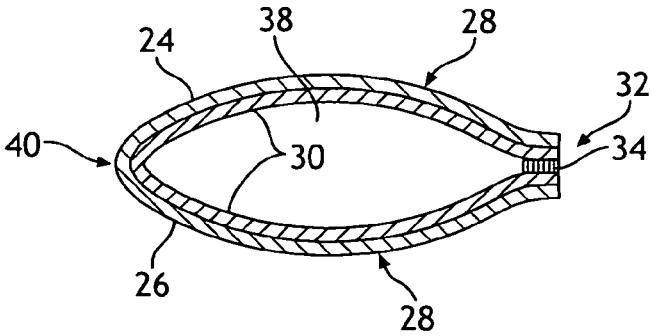
FIG. 4 illustrates a cross-section view of another embodiment of the tissue product

Referring now to FIG. 4, a cross-section of an alternative embodiment of the invention is shown. The product includes a plurality of sheets 20 separated by lines of weakness 22. Each sheet includes a first ply 24 and a second ply 26 in a facing relationship. The first and the second plies (24, 26) each include a hydrophilic layer 28 and a hydrophobic layer 30. The hydrophobic layer 30 of the first ply 24 is arranged facing the hydrophobic layer 30 of the second ply 26. The first and second plies (24, 26) are joined to each other at joining region 32. The embodiment of FIG. 4 differs from the embodiment of FIG. 3 in that one of the joined edges (34 or 36) is replaced by a folded edge 40. To produce this embodiment, the sheets 20 are folded approximately in half along the MD by a folding board and then joined to form the top joined edge 34. The resulting product is similar to FIGS. 2 and 3; however, the bottom joined edge 36 is replaced by the folded edge 40. Alternatively, the top joined edge 34 could be replaced with the folded edge 40 and the bottom joined edge 36 retained. This embodiment provides similar benefits to the embodiment of FIG. 3, but it can be more economical to produce since less adhesive or bonding is required to join the two plies (24, 26) together.

The joined edge 34, rather than being joined as shown, could be overlapped such that the hydrophilic layer 28 of one ply was joined to the hydrophobic layer 30 of the other ply. Alternatively, two seams could be used with one seam joining the two hydrophobic layers together and a second seam joining the two hydrophilic layers could be used. If desired, the two seams could be staggered.

If desired, the embodiments of FIGS. 3 and 4 can use a pressure sensitive adhesive or other joined edge that allows for one or both joined edges (34 and 36) to be readily opened. In this manner, the product can be converted from a sleeve into a placemat having a hydrophilic layer and a hydrophobic barrier layer. This provides for an increased versatility of the sheets 20 to use either as a wiper or as a placemat. The embodiment of FIG. 4 is especially desirable for this application since the folded edge 40 can be unfolded after the joined edge 34 is opened or peeled apart and the sheet 20 laid flat onto a table or counter with the hydrophilic layer facing up. The embodiments of FIGS. 3 and 4 are sleeve-like products where two opposite edges of the plies are not joined and the other two opposite edges are joined.

Referring now to FIGS. 5, 6, 7, and 8 alternative embodiments of the invention are illustrated. In these embodiments, at least three of the four edges of each sheet 20 are joined together leaving the fourth edge openable to form a pocket 42. In this manner, mitt-like products are produced rather than a sleeve. Each sheet 20 includes a first ply 24 and a second ply 26 in a facing relationship. The first and the second plies (24, 26) each include a hydrophilic layer 28 and a hydrophobic layer 30. The hydrophobic layer 30 of the first-ply 24 is arranged facing the hydrophobic layer 30 of the second-ply 26. The first and second plies (24, 26) are joined to each other at joining regions 32.

Figure 5:
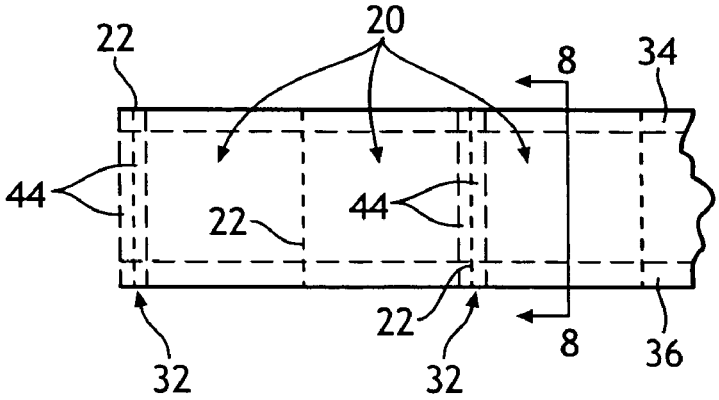
FIG. 5 illustrates a plan view of another embodiment of the tissue product
Figure 8:
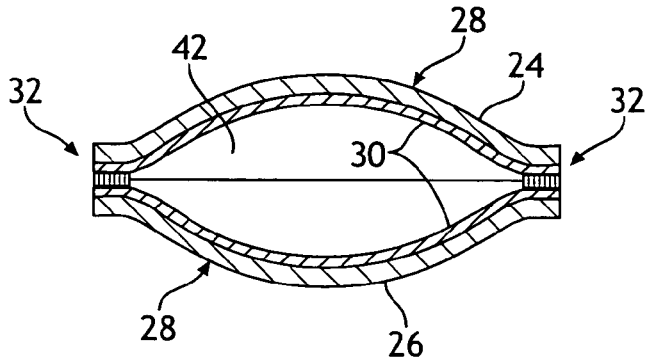
FIG. 8 illustrates a cross section taken at 8-8 of FIGS. 5, 6, and 7

Referring to FIGS. 5 and 8, one example of joining three of the four edges of the plurality of sheets 20 is shown. In this embodiment, each sheet 20 includes a top joined edge 34 and a bottom joined edge 36. Located at every other line of weakness 22 is a side joined edge 44 between the first and the second plies (24, 26). The side joined edge 44 is wide enough such that a line of weakness 22 can be placed coincident and within the side joined edge 44 for the purpose of separating adjacent sheets at the joined region 32. After separation, a side joined edge 44 is present on each adjacent sheet 20. The first and second plies (24, 26) are not joined together at the adjacent lines of weakness 22 located on opposite sides of the side joined edge 44. Stated differently, every other line of weakness 22 is placed within a side joined edge 44.

As the individual sheets 20 are separated from the plurality of sheets, one side edge is joined together by the side joined edge 44, and at the opposing side edge, the first and second plies can be separated to form the pocket 42. Thus, as each sheet 22 is ripped from the plurality of sheets, it will be joined along three of the four edges and be openable into a pocket along the fourth edge. In this embodiment, an individual sheet will have a top joined edge 34, a bottom joined edge 36, and a side joined edge 44. The top and bottom joined edges (34, 36) are located in the MD with the lines of weakness 22 and the side joined edge 44 located perpendicular to the top and bottom edges in the CD. In this manner, the product can be used for wiping up spills with either or both of the hydrophilic layers 28 of the first or second plies (24, 26) while the hand remains protected and dry by the hydrophobic layers 30 of the first and second plies (24, 26). Either side of the sheet 20 may be used without compromising the hand protection of the user.

Figure 6:
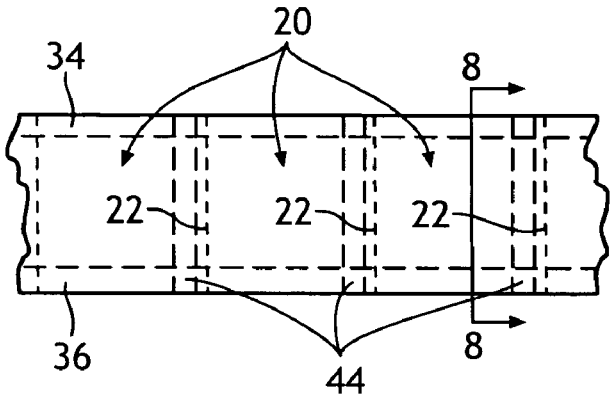
FIG. 6 illustrates a plan view of another embodiment of the tissue product

Referring now to FIGS. 6 and 8, another example of joining at least three of the four edges of each sheet 20 together, leaving the fourth edge open to form the pocket 42, is shown. Each sheet includes a top joined edge 34 and a bottom joined edge 36. Located either to the right or the left of every line of weakness 22, adjacent to the line of weakness, is a side joined edge 44, joining the first and the second plies (24, 26) together. After separation, a side joined edge 44 is present on each adjacent sheet 20. The first and second plies (24, 26) are not joined together at the lines of weakness 22 separating adjacent sheets.

As the individual sheets 20 are separated from the plurality of sheets, one of the side edges is joined by the side joined edge 44, and at the opposing side edge, the first and second plies can be separated to form the pocket 42. Thus, as each sheet 22 is ripped from the plurality of sheets, it will be joined along three of the four edges and be openable into a pocket along the fourth edge. In this embodiment, an individual sheet will have a top joined edge 34, a bottom joined edge 36, and a side joined edge 44. The top and bottom joined edges (34, 36) are located in the MD with the lines of weakness 22 and the side joined edges 44 located perpendicular to the top and bottom edges in the CD. In this manner, the product can be used for wiping up spills with either or both of the hydrophilic layers 28 of the first or second ply (24, 26) while the hand remains protected and dry by the hydrophobic layers 30 of the first and second plies (24, 26). Either side of the sheet 20 may be used without compromising the hand protection of the user.

Figure 7:
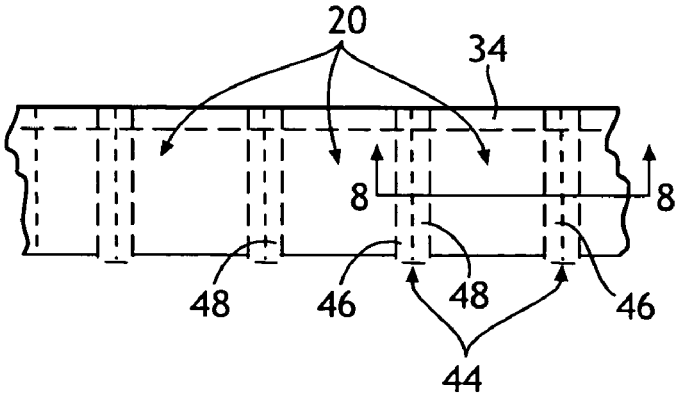
FIG. 7 illustrates a plan view of another embodiment of the tissue product

Referring now to FIGS. 7 and 8, another example of joining at least three of the four edges of each sheet 20 together, leaving the fourth edge open to form the pocket 42, is shown. Each sheet 20 includes a top joined edge 34 or a bottom joined edge 36 but not both. Located at every line of weakness 22 is a side joined edge 44 holding the first and the second plies (24, 26) together. The side joined edge 44 is wide enough such that a line of weakness can be placed coincident and within the side joined edge 44 for the purpose of separating adjacent sheets at the joined region 32. After separation, a right side joined edge 46 and a left side joined edge 48 is present on each adjacent sheet 20. The first and second plies (24, 26) are not joined together at the bottom of the sheet.

As the individual sheets 20 are separated from the plurality of sheets, each side edge will be joined and the top side edge is joined. At the bottom, the first and second plies can be separated to form the pocket 42. Thus, as each sheet 20 is ripped from the plurality of sheets, it will be joined along three of the four edges and be openable into a pocket along the fourth edge. In this embodiment, an individual sheet will have a top joined edge 34, a right side joined edge 46, and a left side joined edge 48. The top joined edge 34 is located in the MD with the lines of weakness 22 and the side joined edges (46, 48) located perpendicular to the top and bottom edges in the CD. In this manner, the product can be used for wiping up spills with either or both of the hydrophilic layers 28 of the first or second plies (24, 26) while the hand remains protected and dry by the hydrophobic layers 30 of the first and second plies (24, 26). Either side of the sheet 20 may be used without compromising the hand protection of the user.

For the embodiments of FIGS. 5, 6, and 7, either the top joined edge 34 or the bottom joined edge 36 can be replaced with a folded edge 40 similar to FIG. 4. In the embodiments of FIGS. 5 and 6, an individual sheet 20 will have either a top or a bottom joined edge (34, 36), either a top or a bottom folded edge 40, and one side joined edge 44. Thus, two of the four edges of the sheet will be joined, one will be folded, and at the remaining edge, the first and second plies (24, 26) are separable to form the pocket 42. Additionally, one or more of the joined edges can be releasably attached such the sheet 20 can be opened up and used as a placement as discussed previously for the sleeved sheets.

In the embodiment of FIG. 7, an individual sheet will have either a top or a bottom folded edge 40, a right side joined edge 46, and a left side joined edge 48. At the remaining edge, the first and second plies (24, 26) are separable to form the pocket 42. In a desired embodiment of the folded execution, top joined edge 34 is replaced with a folded edge 40, and, at the bottom edge the first and the second plies (24, 26) are not joined. An adhesive is used to form the side joined edges 44 that are separable at the lines of weakness 22 into the right and the left side joined edges (46, 48). The top folded edge 40 is located in the MD with the lines of weakness 22 and the side joined edges (46, 48) located perpendicular to the top and bottom edges in the CD. Desirably, the line of weakness 22 and the side joined edges traverse the entire distance from the top folded edge to the bottom openable edge. One advantage of this embodiment is that when wiping in a left to right motion, after placing your hand into the pocket, the wiping motion would be along the MD orientation of the plies (24, 26). Typically, the plies' tensile strength and stretch in the MD is greater than the CD.

In various embodiments of the invention, the hydrophilic layer 28 can comprise fibers. It may be comprised of any type of natural or synthetic fiber, and desirably natural fibers. Fiber furnish selection may depend upon the particular application for which the product is intended. For example, if the sheet is intended to be used in paper towel type applications, the furnish may be BCTMP, NSWK or combinations thereof. The basis weight of the hydrophilic layer may, for example, be between about 10 gsm to about 100 gsm, or between about 20 gsm to about 90 gsm, or between about 30 gsm to about 90 gsm.

The hydrophilic layer 28 can be made by any method known in the art including air laid, wet laid, coform, etc. For wet laid, the hydrophilic layer can be wet pressed, conventional through-air dried, or uncreped through-air dried tissue. Uncreped through-air dried absorbent tissue may be preferred, due to greater wet resilience and absorbent capacity.

The absorbent capacity of the hydrophilic layer is desirably high. The specific absorbent capacity of this layer is desirably about 4 g/g or greater, such as between about 4 g/g to about 30 g/g, or between about 4 g/g to about 20 g/g, or between about 5 g/g to about 15 g/g. The hydrophilic layer may comprise a layer, a single ply, or multiple plies of tissue and, in a desired embodiment, is a single ply.

The hydrophobic layer 30 can increase the fiber absorbent capacity of the cellulosic web. The fiber absorbent capacity of the laminate is defined as the weight of water retained by the laminate (combined hydrophilic layer and hydrophobic layer of one ply 24, 26) divided by the weight of fiber in the laminate. The hydrophilic layer's absorbent capacity of the laminate can vary significantly and can range between about 4 g/g fiber to about 15 g/g of fiber. In one embodiment, it is advantageous to use through-air dried tissue such as uncreped through-air dried tissue. In a desirable embodiment, the hydrophilic layer comprises a through-air dried tissue having a basis weight of between about 20 gsm to about 90 gsm. In another desirable embodiment, the absorbent layer is a through-air dried sheet having high wet resiliency as described in U.S. Pat. No. 6,808,790 B2, entitled "Wet-resilient Webs and Disposable Articles Made Therewith" and issued Oct. 26, 2004, to Chen et al.

The hydrophobic layer 30 may be a polymeric film material such as polyethylene or polypropylene or, on the other hand, may be formed from a nonwoven or other material. The nonwoven, for example, may be constructed so as to have a HST value that falls within the above described ranges. The nonwoven web may be, for instance, a meltspun web or a hydroentangled web. In another embodiment the hydrophobic layer (30) may comprise a sheet or sheets of highly sized cellulosic fibers such as a highly sized tissue sheet. Sizing of tissue sheets is described, for example, in U.S. Pat. No. 6,027,611 entitled Facial Tissue With Reduced Moisture Penetration that issued Feb. 22, 2000 to McFarland et al.

When the hydrophobic layer comprises a film, in general, any suitable film may be used. The film may be made from, for example, a homopolymer, a copolymer, a blend of polymers or a multi-layered film. In one embodiment, for instance, the film may contain a polyolefin such as polyethylene or polypropylene. In an alternative embodiment, the polymer film may contain NYLON (polyamide), a fluoropolymer, PEEK, polyphenylene sulfide, and mixtures thereof. The above polymers may be well suited to applications where the sheet 20 is used as a cutting surface. In another embodiment, the film may comprise or have a layer of high coefficient of friction polymer (such as a block copolymer, i.e. SEB-S block copolymer) on one side to impart a non-slip attribute between the hand and the inside of the sleeve or pocket.

When a polymer film is used, the film may have a thickness that varies greatly depending upon the particular application. For example, in one embodiment, the film may have a thickness of less than about 1 mil to about 10 mils, such as between about 0.1 mil to about 5 mils, or between about 0.1 mil to about 2 mils. In general, lower thickness films may be preferred so as to minimize any stiffness that may be imparted into the product by incorporation of the film. The basis weight of the polymeric film can likewise vary over a wide range. For example, the basis weight may range from about 2 gsm to about 50 gsm, such as between about 4 gsm to about 30 gsm. In a specific embodiment, the basis weight of the film is less than about 20 gsm and the thickness of the film is desirably less than about 2 mils (0.002"). Lower calipers tend to reduce the stiffness of the product and facilitate conformation of the sheet 20 to the hand and facilitation of dislodging, pickup and removal of the dirt or other unwanted material being removed by the sheet.

In a specific embodiment, the film is selected from a polyethylene or polypropylene film having a basis weight of less than about 20 gsm and a caliper of less than about 1 mil. In another specific embodiment, the film is polyethylene. Polyethylene films may be preferred in some applications due to their softer feel and lower stiffness. Polyethylene films may be desirably used to avoid or reduce the crinkling sound that may occur when a polypropylene film is used and the laminated product is crumpled with the hand. While this noise does not impact the physical performance of the product, it may generate a sensory response indicating the product to be less soft and less conformable. More conformable products are believed to be better at cleaning in confined areas such as corners and curvilinear surfaces.

The hydrophobic layer 30 may be laminated or joined to the hydrophilic layer 28 by any means known in the art. For example, films may be laminated to the absorbent layer by patterned heat embossing, hot melt blown glue lamination, melt blowing the film directly onto the absorbent layer, adhesives, as well as other means described in the art. Where absorbent capacity is desired, patterned heat embossing may be a preferred embodiment. Patterned heat embossing can increase the absorbent capacity on a g/cm$^2$ basis above that of the absorbent layer itself.

If the hydrophobic layer (30) comprises a highly sized cellulosic sheet, such as a tissue sheet, the absorbent layer (28) and hydrophobic layer (30) likewise can be laminated or joined by any method known in the art for laminating tissue plies such as hot melt adhesive lamination, heated glue embossing and others. The specific method of lamination is not important so long as the required product properties are met. When laminating cellulosic plies, the adhesive desirably covers the surface in a uniform manner, either continuous or patterned, and is not just present at the perimeter of the sheet.

In one embodiment, there may be advantages to using a film that has a relatively high opacity. Clear film laminates may give the impression to the user of being wet during use even though fluids are prevented from passing through the film. A film having a relatively high opacity, on the other hand, provides a visual cue to the user that fluid strikethrough has not occurred. Opacity represents a substrate's light blocking ability. It can be used as a property of paper and predicts the relative visibility on one side of the paper of the images that exist on the other side. The opacity of polymer films can be measured using TAPPI procedure T 425 and/or ASTM procedure D 589. There are two different ways to report opacity, the more common being the "89% reflectance backing," also called "contrast ratio." This value is equal to 100 times the ratio of the diffuse reflectance of a film sample backed by a black body (<5% reflectance) to the diffuse reflectance of the same sample backed by a white body (89% reflectance). The units are percent, and a perfectly opaque material will have an opacity value of 100%. The opacity of the film, for instance, may be between about 40% to about 100%, or between about 50% to about 100%, or between about 60% to about 100%.

In other embodiments, it may be preferred or sufficient to use translucent films. Translucent films are measured by a haze value and not opacity. Haze is the scattering of light by a film that results in a cloudy appearance or poorer clarity of objects when viewed through the film. More technically, haze is the percentage of light transmitted through a film that is deflected more than 2.5° (degrees) from the direction of the incoming beam. A unidirectional perpendicular light beam is directed onto the film specimen, and a photo detector measures the total light transmitted by the specimen after it enters an integrating sphere. Testing for haze in films should be done by a method such as ASTM D-1003 or equivalent. A spectrophotometer may also be used provided that it meets the requirement of ASTM D-1003. Translucent films suitable for the present invention may have haze values greater than 10%, such as greater than 20%. In one specific embodiment the film may be diffusing, having a haze value greater than 30%.

In other embodiments, transparent films may also be used to satisfaction in the present invention. Such films will have haze values less than 10%, such as less than 5% and specifically less than 3% when measured by ASTM D-1003 or equivalent.

The hydrophobic layer and the hydrophilic layer can be separate individual layers assembled from one or more materials or they may be distinct layers within a single ply material. In one embodiment of the invention, a laminated material having a 12 g/m2 polypropylene sheet laminated to an 88 g/m2 wet pressed tissue was used for the first and second plies (24, 26). Such a material is sold by NPS Corporation, located in Green Bay, Wis.

In various embodiments of the invention, the spacing between joined edges of the pocket or the sleeve can be greater than about 4 inches, or between about 5 inches to about 14 inches, or between about 6 inches to about 12 inches. The spacing should be sufficiently large to easily insert a hand into the pocket or sleeve. In various embodiments of the invention, the overall MD length of the sheet between lines of weakness can be between about 5 inches to about 14 inches, or between about 5.5 inches to about 13 inches, or between about 6 inches to about 12 inches. The CD width of the sheet can vary and can be between about 6 inches to about 14 inches, or between about 7 inches to about 13 inches, or between about 8 inches to about 12 inches.

In a preferred embodiment, the plurality of sheets are delivered in a format comprising a plurality of spirally wound sheets or a stack of sheets, each ply of the product desirably has a small caliper, such that the caliper of each ply (24, 26) is less than about 1,000 microns. For example, in one embodiment, the caliper of each ply may range from about 40 microns to about 800 microns, such as from about 60 microns to about 500 microns. A thinner material can conform to the surface better for wiping and/or be easier to manipulate when picking up materials or wrapping incontinent pads.

Figure 9:
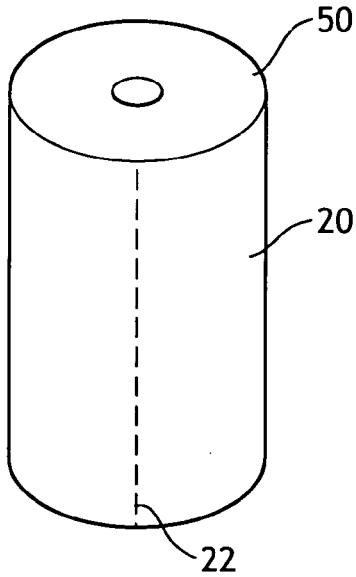
FIG. 9 illustrates a roll of the tissue product

Referring now to FIG. 9, a roll 50 is shown that is wound from the plurality of sheets 20. Desirably, the roll has a height between about 6 inches to about 14 inches, or between about 8 inches to about 12 inches, and a diameter between about 4 inches to about 8 inches, or between about 4.5 inches to about 7 inches. The roll may contain between about 20 to about 100 individual sheets or between about 25 to about 70 individual sheets. The individual sheets desirably have a single side area of the first or second ply (24, 26) of between about 30 in$^2$ to about 200 in$^2$ or between about 40 in$^2$ to about 150 in$^2$.

In order to form a uniform roll 50 that resists damage in shipping and has better integrity, it is desirable that the first ply 24 and the second ply 26 are substantially co-extensive with each having approximately the same size such that the overall caliper of the sheets 20 is as uniform as possible. Furthermore, to prevent waste in cutting the sheets to a mitt shaped profile having a straight bottom, a rounded top and sloping sides, it is desirable that the first and second ply have a square or rectangular profile or shape instead of a profile having a curvilinear shape. A square or rectangular profile is better suited to winding into a more uniform roll. A square or rectangular profile also allows for the sheets 20 to be used in a manner just like a conventional paper towel sheet should the person not want to take the time to insert their hand into the sleeve 38 or pocket 42. If the sheets 20 had a curvilinear mitt shape with a rounded top end, the roll 50 when wound would have one edge that was uniform and resisted deformation, while the other edge would be wavy and scalloped and easily deformed where the mitt's rounded top was wound into a roll. Lastly, should the sheets 20 have a non-uniform caliper, it is desired that the thicker areas of the sheets 20 be located at the top and bottom joined edges (34 and 36). This will produce a more uniform roll having tightly wound edges that better resist crushing and deformation. For example, the embodiments of FIGS. 5 and 6 may wind more uniformly into a roll should the top and bottom joined edges (34, and 36) be thicker than other portions of the sheet 20. The embodiment of FIG. 7, having only a top joined edge 34, may wind into a conically shaped or tapered roll having one end with a larger diameter than the other end if the caliper of the sheet 20 is significantly greater at the top joined edge 34.

Figure 10:
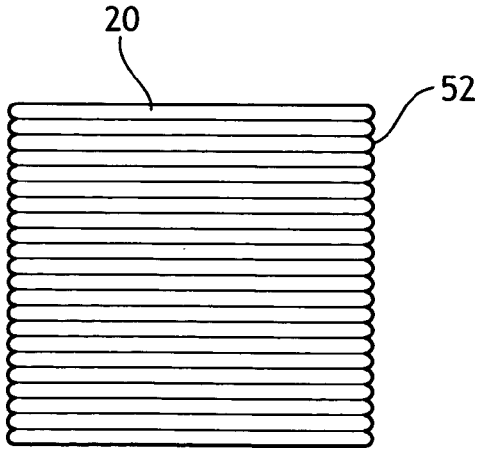
FIG. 10 illustrates a stack of the tissue product

Referring now to FIG. 10, a fan-folded stack 52 is shown that is assembled from the plurality of sheets by fan folding them in the CD. Desirably, the stack has a height between about 3 inches to about 14 inches, a width between about 3 inches to about 10 inches, and a depth of between about 6 inches to about 14 inches. The stack may contain between about 5 to about 250 individual sheets or more. The roll 50, or the stack 52, can be formed from any of the embodiments for the plurality of sheets 20 discussed. Additionally, the roll 50, or the stack 52, can be placed into a suitable dispenser for dispensing the sheets 20.

While the above utility of the sheets 20 has been focused on using the product as a wiper for wiping, there are additional applications for the product. For example, the embodiments shown in FIGS. 5-10 can be used as a pet excrement containment product. In use, a sheet 20 is removed at the line of weakness 22 and a hand is inserted into the pocket 42. Thus equipped, the product can be used to pick up animal feces, which is often required by law in many areas. Since the hydrophilic layers are exposed, it makes it easier to grab the feces while containing any leaks or runs as the hand stays protected by the hydrophobic layers. With the feces securely grabbed, the product can then be stripped off with the other hand thereby everting (turned inside out) the product such that the feces and the hydrophilic layer are now on the inside, with the hydrophobic layer on the outside. After everting, the product can be folded or otherwise secured to contain the feces until properly disposed. In this manner, the hydrophilic layer will absorb any leaking matter while the hydrophobic layer contains the feces within the product without leaks. Additionally, unlike a plastic bag often used for this purpose, the product can be made opaque so the offending feces are hidden from view while being carried until disposal. Thus, the sheets 20 can be packaged with or provided with instructions for use as a pet feces disposal product.

In another application, the product of FIGS. 1-10 can be used as a discrete disposal means for sanitary napkins, incontinent pads, tampons, or other absorbent articles. Frequently, many people using these products are embarrassed to throw them away in a garbage can; especially, when visiting friends' or relatives' houses. Many people, especially incontinent people, do not want to alert others to their need for using these types of products. They do not want their secret to be discovered. Often, these people change pads and then take the soiled or used pad with them by wrapping it in ordinary bathroom tissue. As such, leakage can be a problem in purses or bags used to temporarily hold the soiled absorbent article until later disposal.

By using the products of this invention, the used absorbent article can be placed into the sleeve 38 or pocket 42 and then disposed of in the regular trash, since it will be discretely hidden by the hydrophilic layer 28, appearing similar to ordinary tissue or paper towels likely to be present in the garbage can. This can be useful to people in their own homes while having company. Alternatively, the sheet 20 can be everted (turned inside out) with the hydrophilic layer to the inside and then the used absorbent article placed into the pocket or sleeve. Once positioned, the used absorbent article can be wrapped by the remainder of the sheet 20 such that, when temporarily placed into a bag or purse, leakage is prevented until proper disposal. This can be useful to people when visiting other homes.

Additionally, since the sheets 20 appear quite similar to ordinary paper towels, they do not draw attention when sitting out in the open or if found in a bag or purse. Since the hydrophobic layer can be fairly odor impervious, wrapping the used absorbent article in the sheet can help to contain any odors given off by the used absorbent article or pet feces. Odor neutralizing methods or fragrances known to those of skill in the art can be incorporated into the sheets to further reduce or conceal odors. The sheets can be made quite opaque and thereby better hide the used absorbent articles during disposal. All of the above features, either individually or in combination, produce a very discreet disposal method for used absorbent articles with the sheets of the present invention. Thus, the sheets 20 can be packaged with or provided with instructions for use as a used absorbent article disposal product.

In an additional embodiment, the sheets 20 can be provided with an adhesive strip on one or both hydrophilic layers 28, and/or on one or both hydrophobic layers 30. The adhesive strip(s) can be covered with a release liner until used. The adhesive strip can be used to secure the open edge(s) of the sleeve 38 or pocket 42 in a closed position after picking up feces or placing a soiled absorbent article in the product.

In an additional embodiment, the sheets 20 can have a convenient method to facilitate finding the opening of the sleeve or pocket. The first ply or second ply (24, 26) could have a semi-circle piece of material removed along the opening of the sleeve or pocket to allow the person to push or grasp the other ply to open the product. The semi-circle piece of removed material can be located along the line of weakness 20. In one embodiment, the size of the semi-circular material removed is approximately equal to the size of a person's thumb such as approximately a 0.5" radius or less. Additionally, the hydrophobic layer 30 could be a different color that contrasted with the color of the hydrophilic layer 28 such that when the semi-circle piece of material has been removed, the opening aid can be easily seen. Other opening aids as known to those of skill in the art can be utilized as well.

Test Methods

Measurement of Product Absorbent Capacity—Laminated or Plied Together Hydrophilic and Hydrophobic Layers The following procedure is used to measure the absorbent capacity of the product. All samples should be conditioned at standard TAPPI conditions for a minimum of 4 hours prior to testing.

A sample specimen 4±0.04 inches by 4±0.04 inches is cut from a ply by using a swing beam cutting machine (SB-20, USM Corporation or equivalent) or a manual paper cutter (McMaster-Carr Supply Co. part #3823A44 or equivalent) and weighed to the nearest 0.01 gram on a balance. To obtain a ply, the product should be separated at the joined regions (32) into the first ply and the second ply and then one ply retained for cutting specimens. The sample specimen is cut such that it does not incorporate any portion of the previously joined edges. The "dry weight" of the sample specimen is recorded. A weighing dish is tarred on the balance. The sample specimen is attached on one end with the minimum length needed to hang the specimen from a pinch type clamp or clip. A container is filled with a sufficient volume of water to insure that the test specimen and clamp can be fully submerged. The water temperature should be maintained at 23+/−3° C. The specimen and clamp are then placed into the water absorbent side up using a tongs. A timer is immediately started. The specimen is allowed to soak in the water for 30+/−5 seconds. The specimen is removed from the water by grasping the clamp with the tongs. The sample is then suspended in air by hanging from the clamp for 30+/−5 seconds. The clamp is shaken lightly once to remove any drips hanging from the specimen. The specimen is then released from the clamp, hydrophilic side up, onto a blotter paper so as to remove any water from the hydrophobic side. Care should be taken to avoid contacting the hydrophilic side of the sample with the blotter paper. The sample's hydrophobic side should be completely contacting the blotter paper. The specimen is allowed to sit on the blotting paper for 1-5 seconds. The specimen is then removed from the blotter and placed on a tared weighing dish and the weight of the wet sample "Wet Weight" recorded to the nearest 0.01 gram. The absorbent capacity in g/cm2, specific absorbent capacity (g water/g sample) or fiber absorbent capacity (g water/g cellulose fiber) can then be determined using the following equations:

$$\text{Absorbent Capacity (g/cm2)} = \frac{\text{Wet Weight (g)} - \text{Dry Weight (g)}}{\text{Sample area}}$$

Where: sample area = 103.23 cm2

$$\text{Specific Absorbent Capacity (g/cm2)} = \frac{\text{Wet Weight (g)} - \text{Dry Weight (g)}}{\text{Dry Weight (g)}}$$

$$\text{Fiber Specific Absorbent Capacity (g/g)} = \frac{\text{Wet Weight (g)} - \text{Dry Weight (g)}}{\text{Fiber weight}}$$

Measurement of Absorbent Capacity—Hydrophilic Layer

This procedure is used to measure the absorbent capacity of the hydrophilic layer without the film or hydrophobic layer present. Carefully separate the hydrophilic layer or ply from the hydrophobic layer or ply. Care should be taken to not rip, distort, or significantly alter the physical properties of the hydrophilic layer. A sample specimen 4±0.04 inches by 4±0.04 inches is cut from the hydrophilic layer using a swing beam cutting machine (SB-20, USM Corporation or equivalent) or a manual paper cutter (McMaster-Carr Supply Co. part #3823A44 or equivalent) and weighed to the nearest 0.01 gram on a balance. The "dry weight" is recorded. A weighing dish is tared on the balance. The sample specimen is attached on one end with the minimum length needed to hang the specimen from a pinch type clamp or clip. A container is filled with a sufficient volume of water to insure that the test specimen and clamp can be fully submerged. The water temperature should be maintained at 23+/−3 degree C. The specimen and clamp are then placed into the water. A timer is immediately started. The specimen is allowed to soak in the water for 30+/−5 seconds. The specimen is removed from the water by grasping the clamp with the tongs. The sample is then suspended in the air by freely hanging from the clamp for 30+/−5 seconds. The clamp is shaken once lightly to remove any drips hanging from the specimen. The specimen is then released from the clap and placed on a tared weighing dish and the weight of the wet sample "Wet Weight" recorded to the nearest 0.01 gram. The absorbent capacity, specific absorbent capacity and fiber absorbent capacity are calculated using the same equations present as above.

Caliper—Laminated or Plied Together Hydrophilic and Hydrophobic Layers

The caliper of the laminated or plied together hydrophilic and hydrophobic layers is measured as follows. Both the film layer (hydrophobic layer) and the absorbent layer (hydrophilic layer) are measured together. The term "caliper", as used herein, is the thickness of a single ply (first ply or second ply) of the product, incorporating at least one hydrophobic layer (30) and at least one hydrophilic layer (28). To obtain the ply, the product should be separated at the joined regions (32) into the first ply and the second ply and then one ply retained for testing. When measuring the caliper, a stack of 10 plies is assembled by stacking the plies with the hydrophilic layer facing up. The caliper is measured as a thickness of a stack of ten plies and then dividing the ten ply thickness by ten. Caliper is expressed in microns. Caliper is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board", optionally with Note 3 for stacked tissue sheets. The micrometer used for carrying out T411 om-89 is a Bulk Micrometer (TMI Model 49-72-00, Amityville, N.Y.) or equivalent, having an anvil diameter of 4 1/16 inches (103.2 millimeters) and an anvil pressure of 220 grams/square inch (3.3 g kilo Pascals).

Hercules Size Test (HST)—Laminated or Plied Together Hydrophilic and Hydrophobic Layers The Hercules size test is done in general accordance with TAPPI method T 530 PM-89, *Size Test for Paper with Ink Resistance*. Hercules Size Test data can be collected on a Model HST tester, or equivalent, using white and green calibration tiles and the black disk provided by the manufacturer. A 2% Napthol Green N dye diluted with distilled water to 1% is used as the dye. All materials are available from Hercules, Inc., Wilmington, Del.

Specimens are conditioned for at least 4 hours at 23+/−1° C. and 50+/−2% relative humidity prior to testing. The test is sensitive to dye solution temperature so the dye solution should also be equilibrated to the controlled condition temperature for a minimum of 4 hours before testing.

Four (4) plies of the product are selected for testing. To obtain each ply, the product should be separated at the joined regions (32) into the first ply and the second ply and then one ply retained for testing. Specimens from each retained ply are cut to an approximate dimension of 2.5×2.5 inches for each ply. The plies are then orientated and stacked to have the hydrophilic layers facing the same direction to form a four-ply stack. The instrument is standardized with white and green calibration tiles per manufacturer's directions. The four-ply stack is placed in the sample holder with the hydrophilic side of the plies facing outward. The specimen is then clamped into the specimen holder. The specimen holder is then positioned in the retaining ring on top of the optical housing. Using the black disk, the instrument zero is calibrated. The black disk is removed and 10+/−0.5 milliliters of dye solution is dispensed into the retaining ring onto the top hydrophilic layer of the four-ply stack and the timer started while placing the black disk back over the specimen. The test time in seconds is recorded from the instrument.

Basis Weight—Laminated or Plied Together Hydrophilic and Hydrophobic Layers

The basis weight and bone dry basis weight of the plies can be determined using a modified TAPPI T410 procedure. To obtain a ply, the product should be separated at the joined regions (32) into the first ply and the second ply and then one ply retained for cutting specimens. As is, basis weight samples are conditioned at 23 degrees C.±1 degree C. and 50±2% relative humidity for a minimum of 4 hours. After conditioning, a stack of 16—3"×3" plies are cut using a die press and associated die. This represents a sample area of 144 $in^2$ or 929 $cm^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The sixteen ply (16) specimen stack is then weighed to the nearest 0.001 gram on a tared analytical balance.

The basis weight in pounds per 2880 $ft^2$ can then be calculated using the following equation:

Basis weight=stack wt. in grams/454*2880

The basis weight in g/m2 (gsm) can be calculated using the following equation:

Basis weight=stack wt. in grams/0.0929

The bone dry basis weight is obtained by weighing a sample can and sample can lid to the nearest 0.001 grams and recording the weight A. The sample stack is placed into the sample can and left uncovered. The uncovered sample can and stack, along with the sample can lid, is placed in a 105 degree C.±2 degree C. oven for a period of 1 hour±5 minutes for sample stacks weighing less than 10 grams and at least 8 hours for sample stacks weighing 10 grams or greater. After the specified oven time has lapsed, the sample can lid is placed on the sample can and the sample can is removed from the oven. The sample can is allowed to cool to approximately ambient temperature but no more than 10 minutes. The sample can, sample can lid, and sample stack are then weighed to the nearest 0.001 gram and the weight C recorded. The bone dry basis weight in pounds/2880 ft2 is calculated using the following equation:

Bone Dry BW(#/2880 ft2)=$(C-A)$/454*2880

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A product comprising:

a plurality of sheets having a machine direction and a cross-machine direction, said sheets being separated by lines of weakness running parallel to the cross-machine direction of the sheets;

each of the sheets comprising at least a first ply and a second ply in a facing relationship, the plies formed by folding the plurality of sheets such that the first ply overlies the second ply;

the first and second plies each comprising a hydrophilic layer and a hydrophobic layer, the hydrophobic layer of the first ply facing the hydrophobic layer of the second ply; and the first ply joined to the second ply along at least one machine direction edge of the sheet such that when an individual sheet is separated from the plurality of sheets a sleeve is formed.

2. A product comprising:

a plurality of sheets having a machine direction and a cross-machine direction, said sheets being separated by lines of weakness running parallel to the cross-machine direction of the sheets;

each of the sheets comprising at least a first ply and a second ply in a facing relationship, the plies formed by folding the plurality of sheets such that the first ply overlies the second ply;

the first and second plies each comprising a hydrophilic layer and a hydrophobic layer, the hydrophobic layer of the first ply facing the hydrophobic layer of the second ply; and the first ply joined to the second ply along at least two edges of the sheet and folded along a third edge running parallel to the machine direction of the sheet, such that when an individual sheet is separated from the plurality of sheets a pocket is formed.

3. The product of claim 1 comprising a top joined machine direction edge, and a bottom folded machine direction edge.

4. The product of claim 2 comprising a top folded machine direction edge, a bottom joined machine direction edge, and a side joined cross-machine direction edge.

5. The product of claim 2 comprising a top folded machine direction edge, a right side joined cross-machine-direction edge, and a left side joined cross-machine-direction edge; and the lines of weakness positioned perpendicular to the top folded edge.

6. The product of claim 4 wherein every other line of weakness is positioned within the side joined edge.

7. The product of claim 4 wherein the side joined edge is located adjacent to each line of weakness.

8. The product of claim 5 wherein each of the lines of weakness is positioned within one of the side joined edges.

9. The product of claim 1 wherein the first ply is releasably joined to the second ply such that the sleeve can be opened into a placemat.

* * * * *